United States Patent [19]

Lawrence

[11] 4,254,538

[45] Mar. 10, 1981

[54] SLIDE FASTENER INSTALLATION AND METHOD OF MAKING THE SAME

[75] Inventor: Charles T. Lawrence, Saegertown, Pa.

[73] Assignee: Textron, Inc., Providence, R.I.

[21] Appl. No.: 737,161

[22] Filed: Oct. 29, 1976

[51] Int. Cl.[3] ..... A44B 19/04

[52] U.S. Cl. ..... 24/205 R; 24/205.11 R; 24/205.16 R

[58] Field of Search ..... 24/205.1 R, 205.13 R, 24/205.13 D, 205.16 R, 205.11 R, 205.16 C, 205.12, 205 R

[56] References Cited

U.S. PATENT DOCUMENTS

| | | | |
|---|---|---|---|
| 2,066,060 | 12/1936 | Sipe | 24/205.1 R |
| 2,768,922 | 10/1956 | Klein | 24/205.16 R |
| 3,302,259 | 2/1967 | Waldes | 24/205.16 R |
| 3,757,391 | 9/1973 | Chuckson et al. | 24/205.13 D |
| 3,848,556 | 11/1974 | Terada et al. | 24/205.16 C |

*Primary Examiner*—Kenneth Dorner

*Attorney, Agent, or Firm*—O'Brien and Marks

[57] ABSTRACT

A slide fastener installation is disclosed in which the trains of coupling elements are adhesively mounted on the article into which the slide fastener is to be installed without the use of mounting tapes. In making this installation, the interlocked trains of elements are mounted on the fabric before a slit is made in the fabric to provide an opening to be closed by the slide fastener.

1 Claim, 5 Drawing Figures

SLIDE FASTENER INSTALLATION AND METHOD OF MAKING THE SAME

BACKGROUND OF THE INVENTION

1. Field of the Invention

The present invention relates in slide fastener installations in general and in particular to the mechanism of attaching the coupling elements to the fabric of the garment.

2. Description of the Prior Art

The prior art is generally cognizant of slide fasteners in which the coupling elements are attached to the garment fabric without the use of mounting tapes. Examples of patents which disclose such slide fasteners are U.S. Pat. No. 2,858,592, U.S Pat. No. 3,490,111 and U.S. Pat. No. 3,600,767. The prior art also includes examples of slide fastener installations in which the mounting tapes of the slide fastener are adhesively secured to the fabric of the garment. One example of such prior art is U.S. Pat. No. 3,561,073.

SUMMARY OF THE INVENTION

The present invention is summarized in that a slide fastener installation includes a single unitary sheet of fabric having a slit formed partway therethrough, two trains of slide fastener coupling elements each mounted on the sheet of fabric adjacent an edge of the slit therein, a slider entrained on the trains for engaging and disengaging the coupling elements of the trains, and a layer of adhesive material bonding the respective coupling elements of the trains to the sheet of fabric.

It is an object of the present invention to provide a slide fastener installation in which the coupling elements are mounted adhesively directly on the fabric of the garment without the need for intervening mounting tapes.

It is another object of the present invention to provide a method of making such a slide fastener installation.

It is yet another object of the present invention to provide such a slide fastener installation that is economical yet durable and a method for making it that is both relatively easy and also economical.

Other objects, features and advantages will become apparent from the following specification when taken in conjunction with the accompanying drawing.

DESCRIPTION OF THE PREFERRED EMBODIMENT

Figure 1:
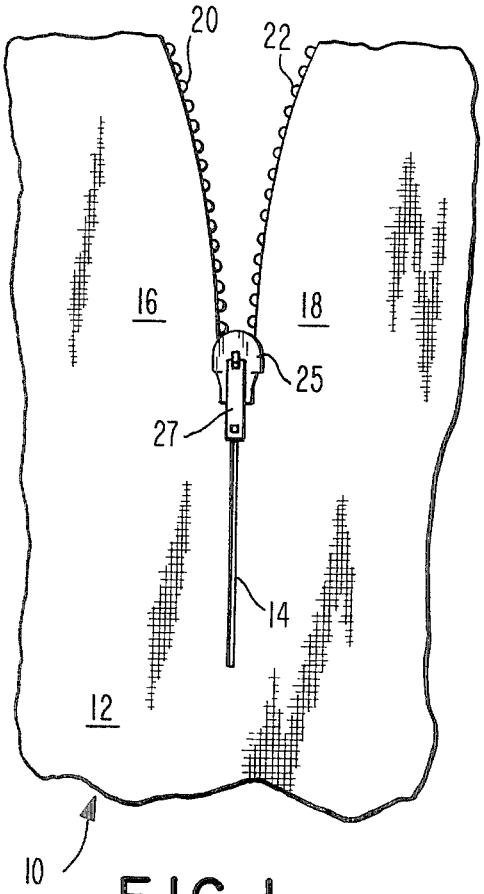
FIG. 1 is a front plan view of a slide fastener installation constructed according to the present invention.
Figure 2:
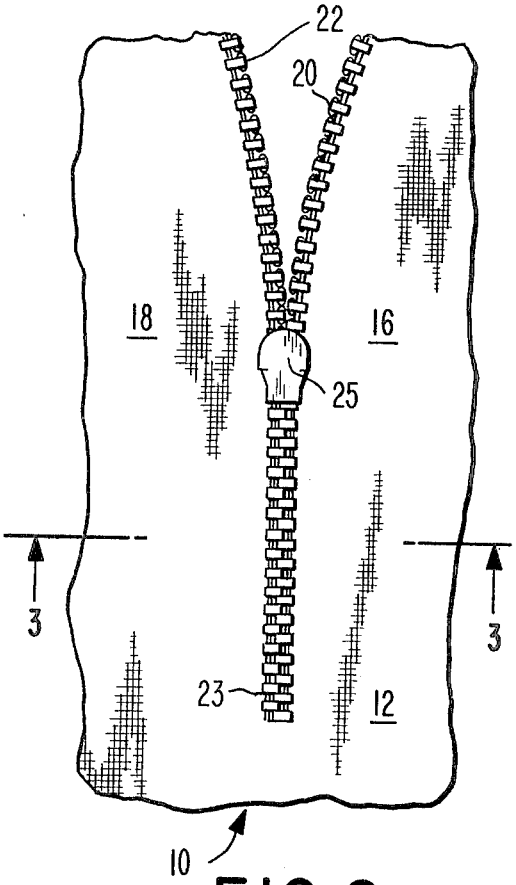
FIG. 2 is a rear plan view of the slide fastener installation of FIG. 1.

Shown in FIGS. 1 and 2 is a slide fastener installation, generally indicated at 10, constructed according to the present invention. The slide fastener installation 10 is installed in a single unitary sheet of fabric 12, which may be of any suitable woven, non-woven, natural or synthetic fabric type, but is preferably formed of a knitted material. A slit 14 is formed partway through the sheet of fabric 12 with the fabric 12 being divided into two fabric portions 16 and 18 by the slit 14. A pair of continuous trains 20 and 22 of slide fastener elements are mounted on the respective edges of each of the fabric sections 16 and 18 adjacent the slit 14. An end portion 23 of the trains 20 and 22 extends onto the sheet of fabric 12 beyond the slit 14. Mounted onto both of the trains 20 and 22 is a slider 25 which is movable up and down the trains 20 and 22 and which has a pull tab 27 secured thereto.

Figure 3:
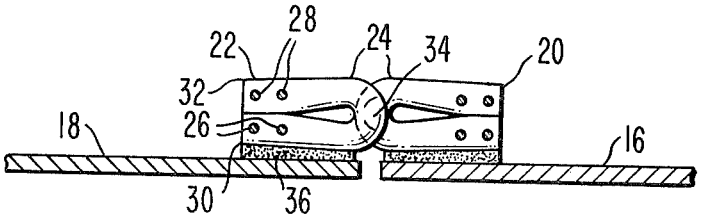
FIG. 3 is a section along the line 3—3 in FIG. 2.

As can best be seen in the cross-section of FIG. 3, each of the trains 20 and 22 includes a plurality of generally identical molded, thermoplastic slide fastener coupling elements 24. The coupling elements 24 of each of the trains 20 and 22 are joined together by two pairs of continuous coupling treads 26 and 28. Each of the coupling elements 24 is formed in a generally arched horseshoe shape forming two parallel legs, a lower leg 30 and an upper leg 32. The outside surfaces of each of the legs 30 and 32 are formed so as to be generally flattened and planar. The lower and upper legs 30 and 32 of each of the coupling elements 24 are joined together by a head portion 34 each of which has locking protrustions formed on either side of it to interlock with the protrusions on the head portion 34 of the coupling elements 24 of the other of the trains. The pairs of coupling threads 26 and 28 are each received through a one of the legs 30 and 32 of each of the coupling elements 24 in each train with the pair of coupling threads 26 extending through the lower leg 30 while the pair of coupling threads 28 extends through the upper leg 32. The lower and upper legs 30 and 32 of each coupling element 24 may be fused together at their extreme end opposite from the head portion 34. The coupling elements 24 of each of the trains 20 and 22 are secured to the edge of the respective fabric section 16 or 18 by a layer of adhesive material 36. The layer of adhesive 36 is disposed in contact with the face of the edge of the respective fabric section 16 or 18 and also the lower surface of the lower leg 30 of each of the coupling elements 24 of each train. The layer of adhesive 36 may be formed of any suitable type of adhesive suitable with the material of the sheet of fabric 12 and the coupling elements 24, but is preferably of the heat-activated or "iron-on" type of adhesive. One such suitable adhesive is Bostich Iron-on Adhesive 7091.

The slide fastener installation 10 of FIGS. 1–3 is operated in a conventional manner by pulling on the pull tab 27 of the slider 25. The slider 26 moves up and down the trains 20 and 22 to respectively engage and disengage the coupling elements 24 of the two trains.

Figure 4:
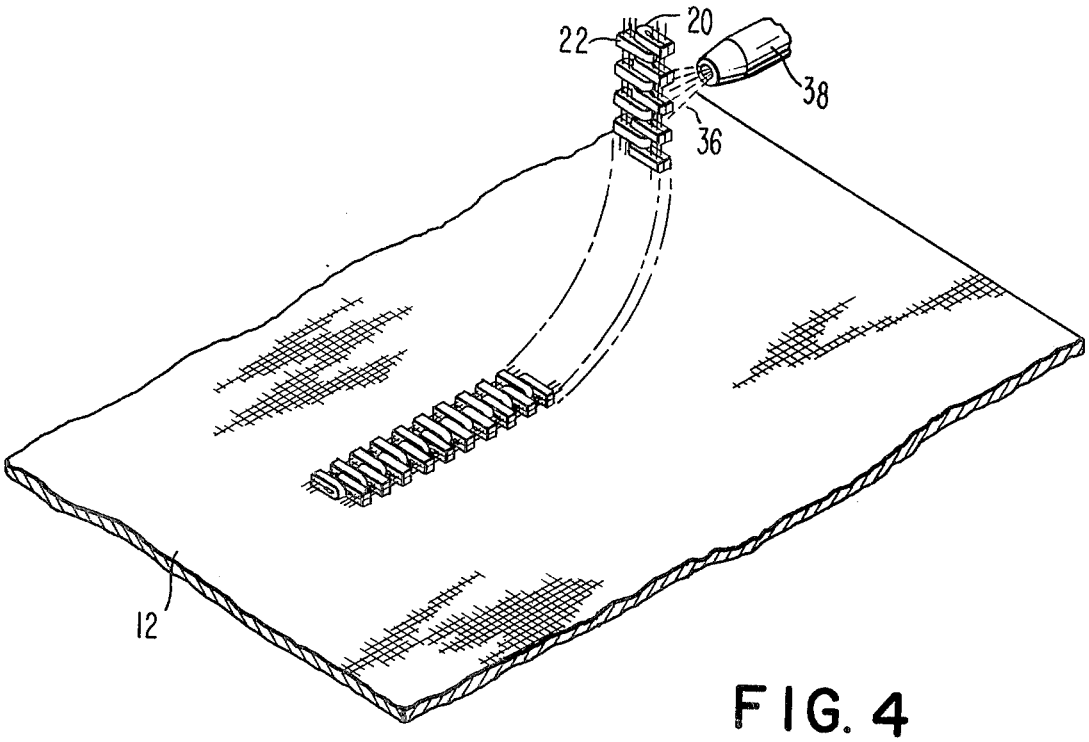
FIG. 4 is an illustration of a step in the method of making the slide fastener installation of FIG. 1.
Figure 5:
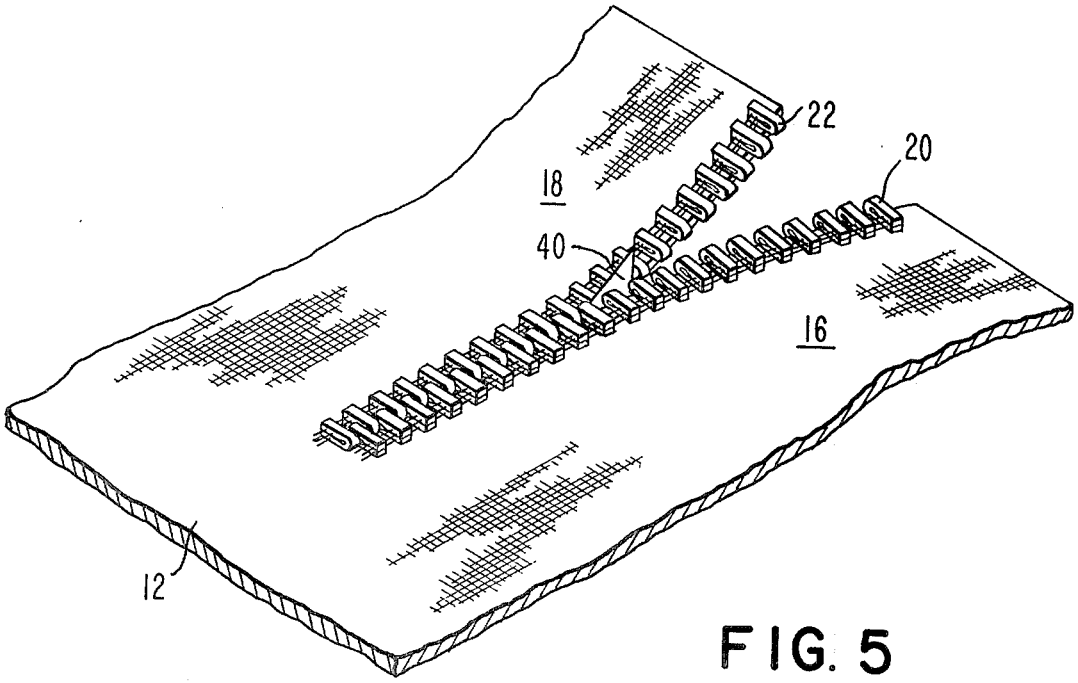
FIG. 5 is a subsequent step in the method of making the slide fastener installation of FIG. 1.

The method of making the slide fastener installation of FIGS. 1–3 is best understood by referring to FIGS. 4 and 5 of the drawings. The trains 20 and 22 are fabricated separately and then interlocked and are supplied to the point of manufacture in this interlocked configuration as shown in FIG. 4. An applicator, such as the sprayer nozzle 38 shown in FIG. 4, then deposits the layer of adhesive upon the lower surfaces of the lower legs 30 of the coupling elements 24 of the interlocked trains 20 and 22. The applicator could be a brush or roller or other type of contact applicator if a sprayer is not suitable for the particular adhesive to be used. The trains 20 and 22 are then brought into contact with the sheet of fabric 12 in the area in which the slide fastener installation 10 is desired. The layer of adhesive 36 is then fixed or activated, if the adhesive requires such activation, by the particular activating medium suitable for the adhesive. Using a heat-activated sort of adhesive for the layer 36, the sheet of fabric 12 and the trains 20 and 22 would be heated in this step, as for example by ironing or heat pressing. Once the adhesive has set and dried, a blade 40 of any suitable character is slowly brought between the trains 20 and 22 which the coupling elements 24 of each of the trains are slowly disengaged. If practical, it could be arranged for the blade 40 to be short enough only to piece the sheet of fabric 12, without scarring the coupling elements 24 of the trains 20 and 22, but as would more likely be the normal case a longer blade 40, such as shown in FIG. 5, can be used if lateral force is exerted on the two fabric sections 16 and 18 to pull the trains 20 and 22 apart. The cutting of the blade 40 creates the slit 14 and separates the fabric sections 16 and 18. The blade 40 is not brought to the extreme end of the trains 20 and 22, however, but instead the cutting is terminated some distance short of such end to leave the end portion 23 intact. The end portion 23 serves a dual role, to limit the travel of the slider 25 so that it cannot be pulled entirely off the trains 20 and 22 and to limit any tearing, as might otherwise occur, in the sheet of fabric 12 which would extend the slit 14 beyond what was desired. The slider 25 with the pull tab 27 is then mounted on the trains 20 and 22 to complete the slide fastener installation 10.

The advantages of the slide fastener installation of the present invention and the method for making it are numerous. Firstly it does away with the mounting tapes used in conventional slide fastener installations thereby obviating the problems of matching colors, textures, and types of fabric as normally crop up in slide fastener installations. The slide fastener installation thus formed is economical yet still sturdy and secure. Such installations are particularly suited for clothing used in spark-free or dust-free environments where the overclothing typically used is often of an economical, disposable nature. Probably the greatest advantage, however, is in the ease of installation, i.e. the ease with which the slide fastener installation can be made. By applying the trains 20 and 22 to the fabric before the slit 14 is formed, all problems of alignment and/or spacing are eliminated. The fastener elements do not have to be carefully aligned relative to a gap that must be closed; rather the opening in the garment that the slide fastener is to close is formed after the fastener is installed. Thus the garment would be made without any openings for the slide fastener installation but the opening is created after the elements of the slide fastener are installed. It is much easier to slit a sheet of fabric along a line determined by the placement of the slide fastener elements than it is to install those elements in their proper alignment with each other along the sides of a slit already formed. Thus both the method and the product of the present invention offer significant adavantages over previously known slide fastener installations.

Inasmuch as the present invention is subject to many variations, modifications, and changes in detail, it is intended that all the subject matter in the foregoing specification or in the accompanying drawings be interpreted as illustrative, rather than in a limiting sense.

What is claimed is:

1. A slide fastener installation comprising a single unitary sheet of knitted fabric having a slit formed partway therethrough, two trains of slide fastener coupling elements each mounted on the sheet of fabric adjacent an edge of the slit therein, each of the coupling elements of each train being formed of molded thermoplastic material and including upper and lower generally parallel legs with a head portion extending therebetween, coupling threads extending through the legs of each coupling element to join the coupling elements of each train, a slider entrained on the trains for engaging and disengaging the coupling elements of the trains, a layer of heat-activated adhesive material bonding the respective lower leg of each of the coupling elements of each of the trains to an edge of the sheet of fabric along the slit therein, and an end portion of each of the trains extending onto the sheet of fabric beyond the slit therein, the coupling elements of each train in the end portion being interengaged and adhered to the sheet of fabric to form an end stop for the slide fastener.

* * * * *